United States Patent [19]

Westmoreland

[11] 4,410,301

[45] Oct. 18, 1983

[54] FLUID COMPRESSOR

[75] Inventor: Julius C. Westmoreland, Marina Del Rey, Calif.

[73] Assignee: Inotek-Westmoreland Venture, Irvine, Calif.

[21] Appl. No.: 297,713

[22] Filed: Aug. 31, 1981

[51] Int. Cl.[3] ..... F04B 17/00

[52] U.S. Cl. ..... 417/264; 417/403

[58] Field of Search ..... 417/264, 392, 393, 399, 417/401, 403

[56] References Cited

U.S. PATENT DOCUMENTS

| | | | |
|---|---|---|---|
| 2,245,501 | 6/1941 | Richardson | 417/403 |
| 2,862,448 | 12/1958 | Belding | 417/392 |
| 3,053,435 | 9/1962 | Sanders et al. | 417/403 |
| 4,157,773 | 6/1979 | Schetina et al. | 417/403 |

FOREIGN PATENT DOCUMENTS

| | | | |
|---|---|---|---|
| 1207515 | 2/1960 | France | 417/403 |
| 1312051 | 11/1962 | France | 417/403 |
| 663848 | 12/1951 | United Kingdom | 417/392 |

*Primary Examiner*—Leonard E. Smith

*Attorney, Agent, or Firm*—George J. Netter

[57] ABSTRACT

The present invention relates generally to an improved fluid compressor and, more particularly, to such a compressor driven by a hydraulic motor, the working liquid of which serves as a coolant for the compressed fluid.

2 Claims, 12 Drawing Figures

FLUID COMPRESSOR

SUMMARY OF THE INVENTION

In the practice of the present invention, a hydraulic motor includes a pair of spaced apart pistons driven in both directions along a cylinder to effect two-stage compression of a fluid (e.g., air). The fluid to be compressed enters the cylinder chamber below one of the pistons through a first check valve. On a pressure stroke, the said piston effects a first stage of compression forcing the fluid through a second check valve in the same piston into a chamber defined by the back side of the same piston and an elongated piston-like member with an outlet passage therein controlled by a second check valve.

As the pair of pistons move in the opposite direction the fluid pressurized to the first stage is further compressed by the back side of the piston against the piston-like member. At the same time, the lower side of the same piston pulls additional fluid into the cylinder chamber through the first check valve.

The working fluid is alternately applied to the pistons via a spool valve to provide the desired reciprocating drive. The working fluid moves along standpipes with the compressor in heat contacting relation to the compressed fluid thereby acting as a coolant.

DESCRIPTION OF A PREFERRED EMBODIMENT

Figure 1:
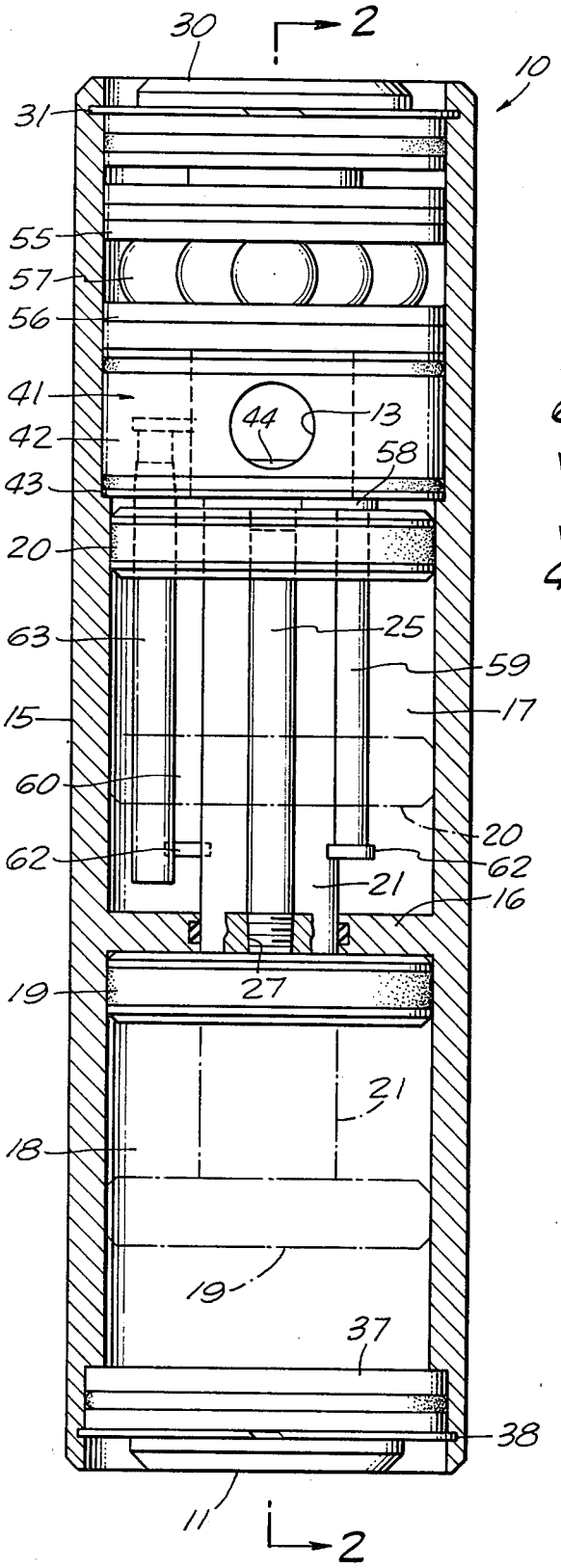
FIG. 1 is a side elevational view of the fluid compressor of this invention.
Figure 2:
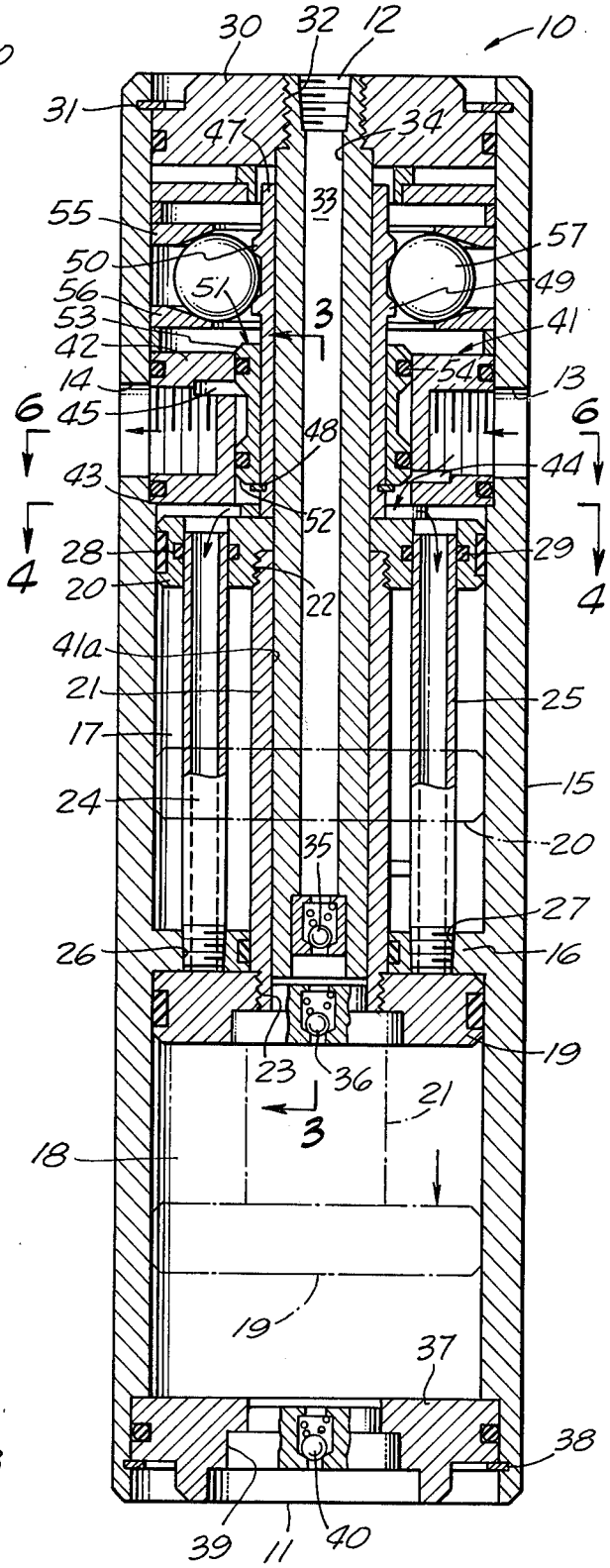
FIG. 2 is a side elevational, sectional view of the compressor taken along the line 2—2 of FIG. 1.

With reference now to the drawing and particularly FIGS. 1 and 2, the compressor of this invention, identified generally as at 10, is seen to include a generally cylindrical structure with the fluid to be compressed (e.g., air) entering at the circular end 11 and after two stages of compression is taken via a suitable fitting 12 in the opposite circular end. Working liquid (e.g., water) for driving the compressor is admitted through an inlet opening 13 in the side wall and exists to a sump via a further side wall opening 14.

The compressor housing 15 is a hollow cylinder with open ends and a centrally located partition 16 separating the housing interior into an upper chamber 17 and a lower chamber 18.

A first piston 19 is dimensioned for sliding travel within the chamber 18. A second piston 20 is located within the upper chamber 17 and has external dimensions permitting sliding receipt within the chamber. A hollow guide tube 21 has each of its threaded ends received within centrally located threaded openings 22 and 23 in pistons 20 and 19, respectively, maintaining them in fixed spaced relation for unitary movement.

A pair of hollow standpipes 24 and 25 have one end threaded into an opening 26 and 27, respectively, which extend completely through the partition 16 and which are located at opposite sides of the upper or free-standing portions of the standpipes slidingly extend through openings in the piston 20. Means 28 and 29 seal the piston 20 and standpipes 24 and 25, respectively.

The upper end of the compressor housing 15 is closed off by a relatively thick end plate 30 which is held within the housing opening by a spring clip 31. The fitting 12 which is threaded within an opening 32 of the end plate is integrally related to one end of an elongated cylindrical rod 33 having an axial bore 34 extending therethrough. The outer diameter of the rod 33 is such as to provide fitting and sliding receipt within the guide tube 21. The lower end of the bores 34 includes a check valve 35 of conventional construction which allows fluid flow in a direction from the valve toward fitting 12 but blocks flow in the opposite direction.

Similarly, a further check valve 36 is located in the opening 23 of piston 19 enabling fluid flow from chamber 18 upwardly, but obstructing fluid flow in the reverse direction.

The lower end of housing 15 is sealingly closed by an end plate 37 which is retained by a spring clip 38. An enlarged central opening 39 includes a check valve 40 of conventional construction permitting ingress of fluid to chamber 18 and preventing fluid flow in the opposite direction.

The working liquid valving means identified generally as at 41 in a way that will be described in detail later herein has a first valving state for providing pressurized fluid from inlet opening 13 to the top side of piston 20 and along standpipes 24 and 25 to the top side of piston 19. The arrows shown in FIG. 2 indicate the described flow of the working fluid. In this manner, the assembly of pistons 19 and 20 moves downward effecting a first stage of compression of fluid in the chamber 18 which acts through check valve 36 and 35 also increasing the pressure of the fluid in bore 34.

Figure 12:
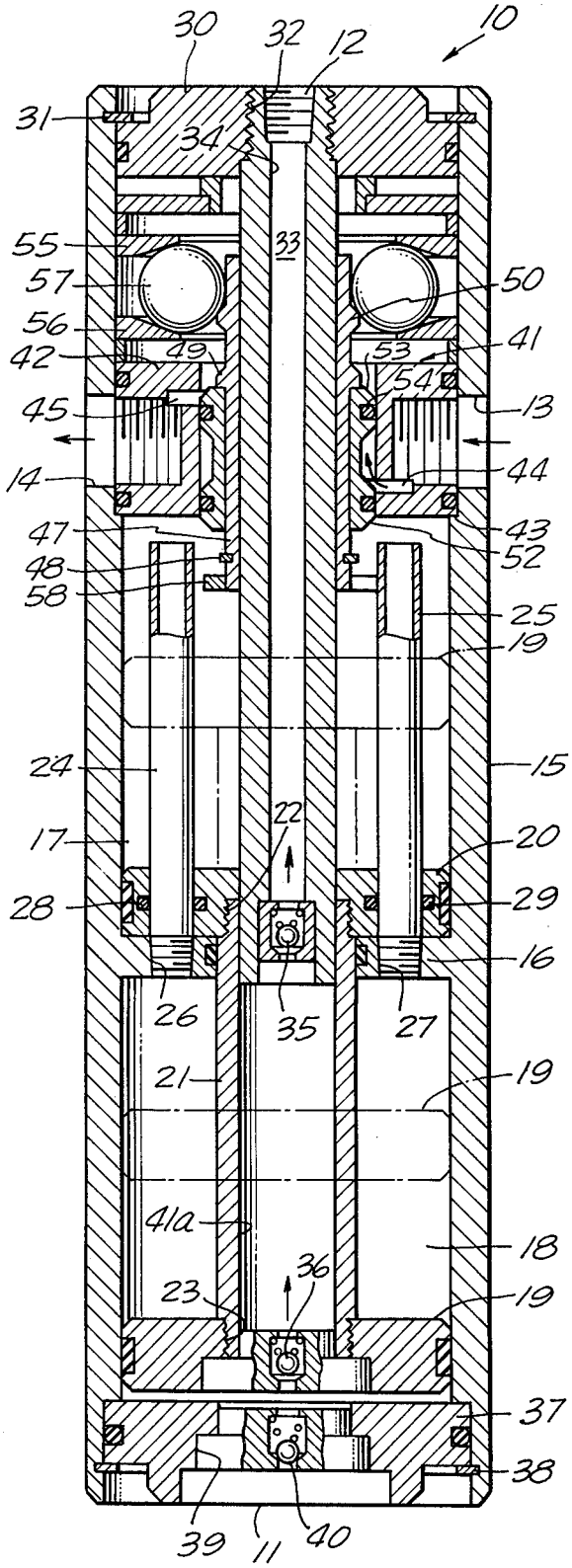

On piston 19 reaching the bottom of the stroke, as shown in FIG. 12, for example, the valving means 41 switches to second control mode in which the pressurized working liquid is applied to the underside of piston 20, while simultaneously interconnecting the working fluid located above the pistons 19 and 20 to the outlet 14 and a sump. Accordingly, the piston assembly begins to rise from the position shown in FIG. 12 which draws in new unpressurized fluid through check valve 40, and at the same time effects a second stage of compression of the previously pressurized fluid which lies in the space within the bore **41*a* of the guide tube 21 and the bore 34 is accomplished. The second stage compression continues until piston 19 once again reaches the uppermost position as in FIG. 2**, and the cycle begins again.

WORKING FLUID VALVE CONSTRUCTION

For the ensuing description of the valving means 41 reference is made primarily to FIGS. 2, and 7–10. The valving means includes a generally annular valve body 42 having a suitable outer diameter enabling fitting and sealing receipt within the interior of housing 15 and positively located against a circular shoulder 43 on the housing inner wall. Threaded inlet and outlet ports for the working liquid are aligned with inlet and exit openings 13 and 14, respectively.

Figure 6:
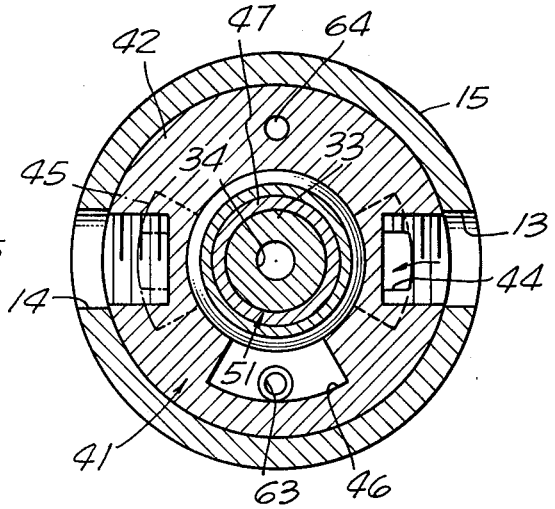
FIG. 6 is a further plan, sectional view through the working fluid valving apparatus similar to FIG. 5.
Figure 7:
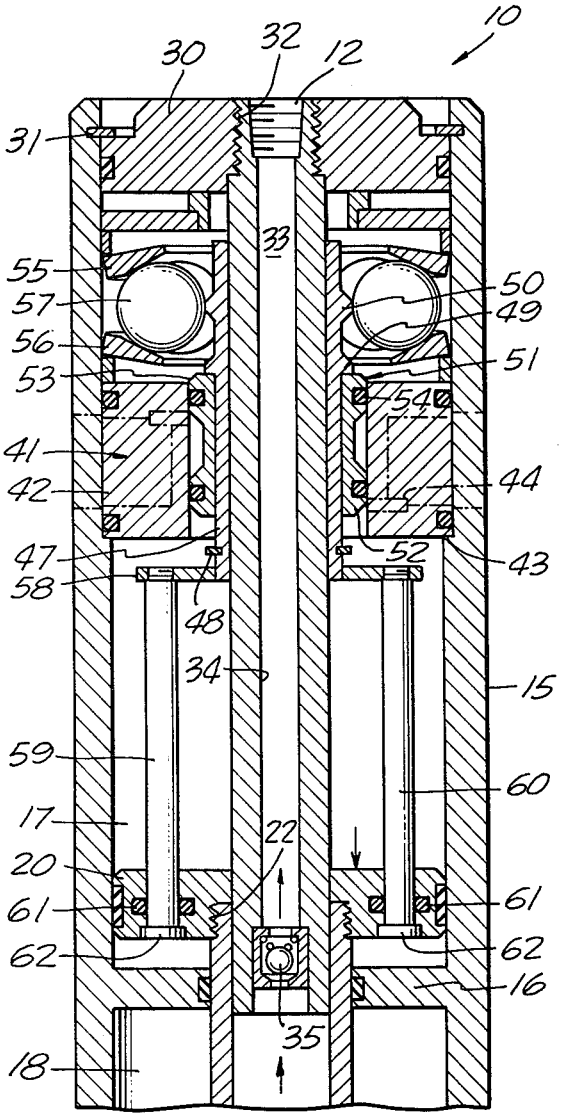
FIG. 7 is a side elevational view similar to FIG. 1 with the compressor shown at the conclusion of the first stage of compression.

A first segmental slot 44 as seen in FIG. 2, extends angularly partway about the central opening of the valving body 42 and establishes communication between the incoming working fluid via the lower part of inlet opening 13 and the valving body central opening (arrow). A second segmental slot 45 is located at 180 degrees, from the slot 44 providing communication between the upper part of the exit opening and the valving body central opening. A third segmental slot 46 lies substantially midway between slots 44 and 45, both measured angularly about the circular center of the valving body (FIG. 6) and vertically along the rod 33.

A valve actuator 47 is a generally tubular affair having an inner diameter that enables sliding receipt onto the cylindrical rod 33. First, second and third spaced continuous ridges or valve spool positioning means 48, 49 and 50 are formed on the outer surface of the actuator for a purpose to be described.

A generally cylindrical spool 51 has an interval permitting sliding receipt on the actuator 47 between the positioning means 48 and 49. First and second raised ridges 52 and 53 at opposite ends of the spool include circular sealing means 54 and are so dimensioned as to provide continuous sealing contact with the inner wall surface defining the valve body central opening. A band-like slot extends completely around the spool and lies between the two ridges 52 and 53.

A pair of circular leaf springs 55 and 56 are located within the housing cavity and held apart by a ball bearing race 57. The peripheral edge portions of the springs are formed as to urge the ball bearings continuously toward the actuator 47.

Figure 5:
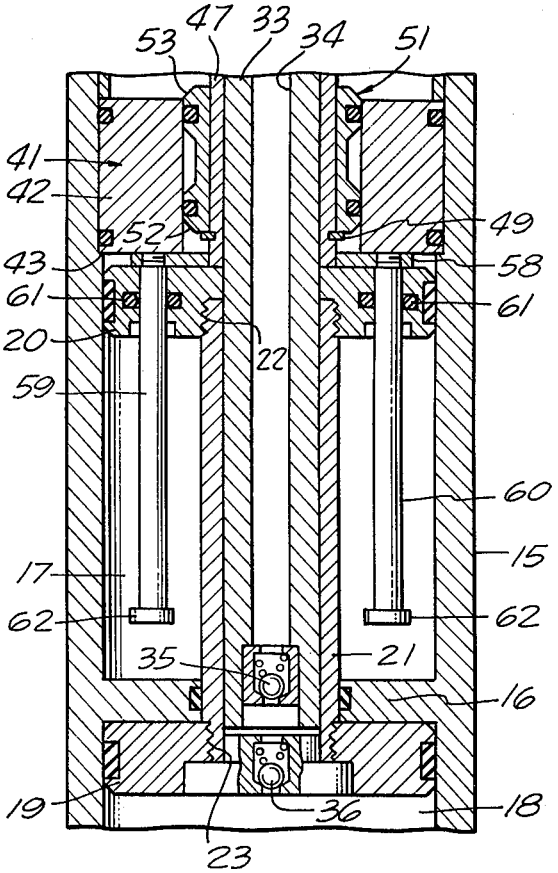
FIG. 5 is a vertical sectional view similar to FIG. 3 taken along the line 5—5 of FIG. 4.
Figure 4:
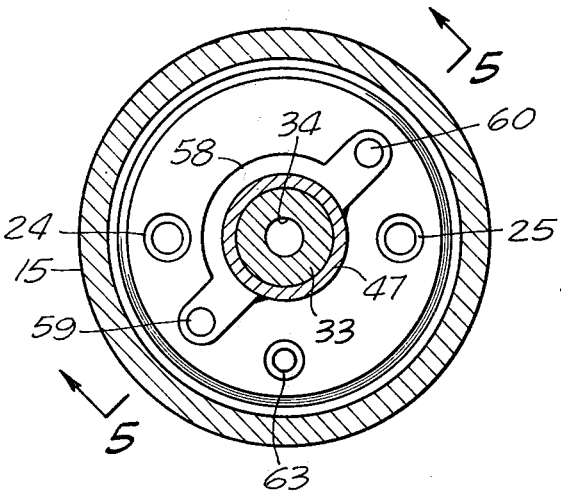
FIG. 4 is a horizontal sectional view taken along the line 4—4 of FIG. 3.

A circular drive plate 58 is interconnected to the lower end of actuator 47 and has an outer diameter somewhat less than that of the housing cavity (FIG. 5). A pair of striker rods 59 and 60 are threadedly affixed to the plate 58 and slidingly extend through openings in the upper piston 20 which are sealed by means 61 to prevent the flow of working liquid therepast. Enlarged ends 62 on rods 59 and 60 engage the piston 20 when it is at its lowermost position.

OPERATION OF WORKING LIQUID VALVE

With the compressor parts initially as shown in FIG. 2, working fluid admitted at 13 moves through the segmental slot 44 into the housing cavity above piston 20 and also down through standpipes 24 and 25 to the top of piston 19. Accordingly, the pistons move downwardly and produce the first stage of compression as already described. At this time, the second and third segmental slots 45 and 46 are in communication with each other via the spool slot between ridges 52 and 53.

Figure 8:
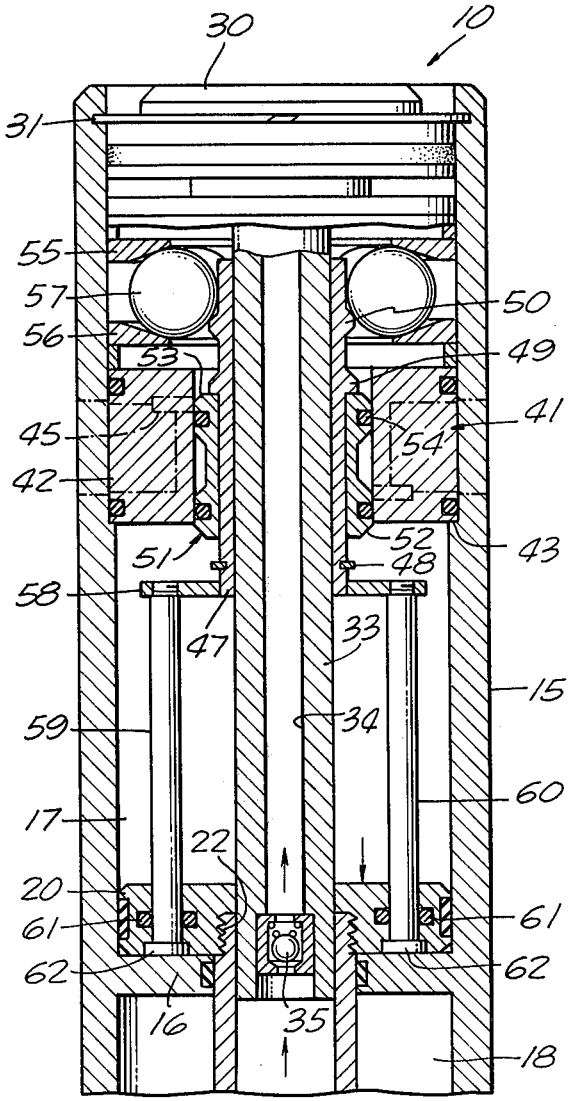
FIG. 8 is a vertical section similar to FIG. 7 showing the valve transfer.
Figure 9:
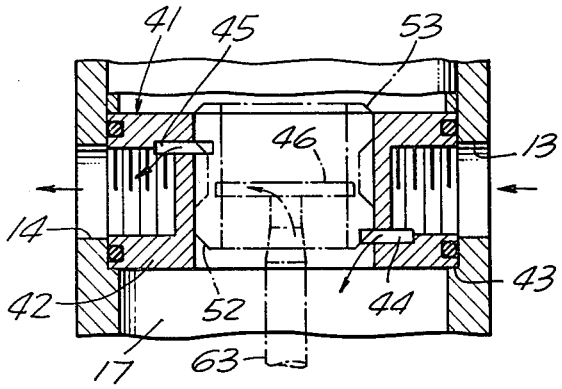
FIGS. 9 and 10 show the two working liquid flow paths through the valving means.
Figure 10:
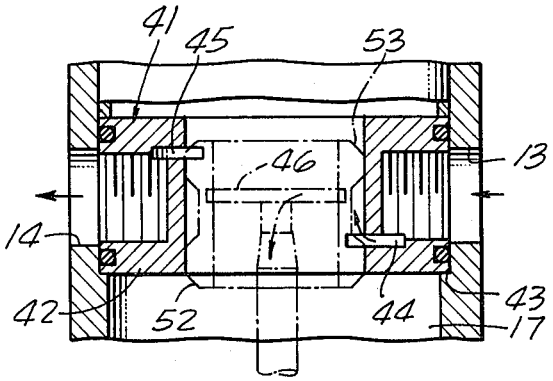
Figure 11:
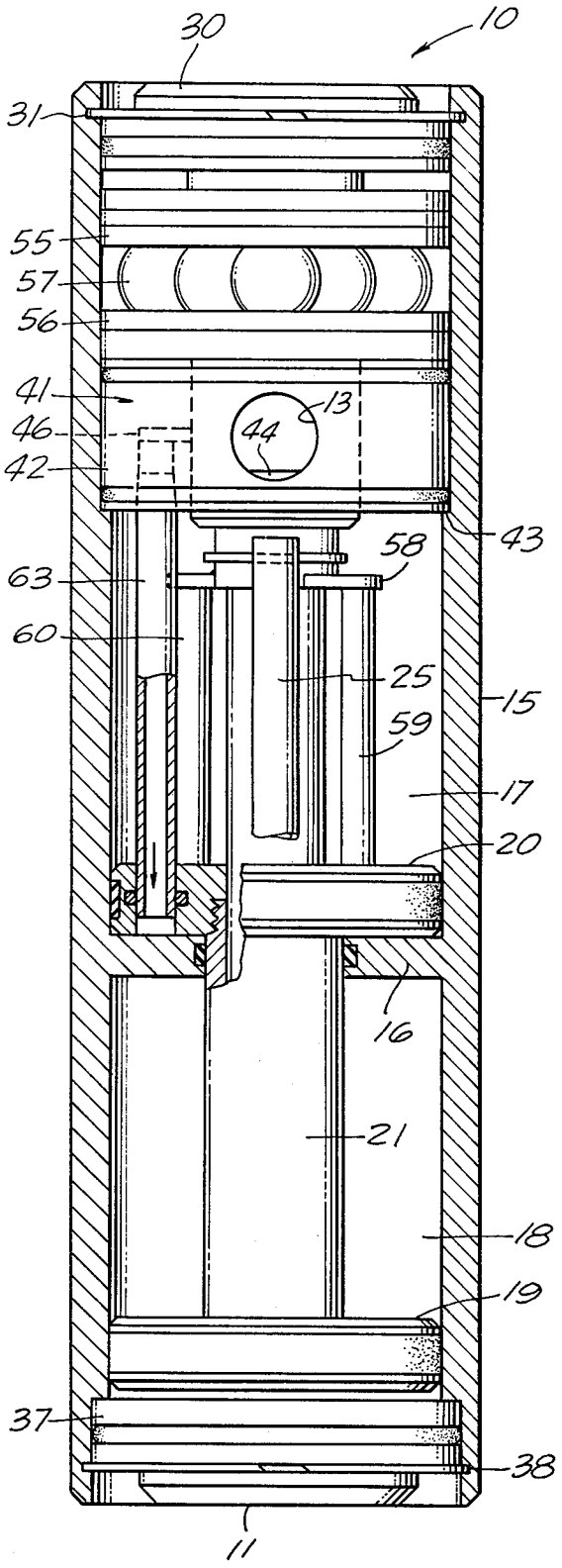
FIGS. 11 and 12 are elevational view similar to FIGS. 1 and 2, respectively, showing the compressor at the opposite extreme of its cycle.

When the piston 20 reaches its lower extremity the enlarged end 62 of striker rods 59 and 60 engage the piston such that on further downward movement the actuator 47 is shifted downwardly (FIG. 8). Ridge 49 on the actuator engages the spool pushing it to the position in FIG. 8 where the third segmental slot 46 is exposed to the housing cavity above the piston 20, and the first and second segmental slots are interconnected via the spool annular slot.

Figure 3:
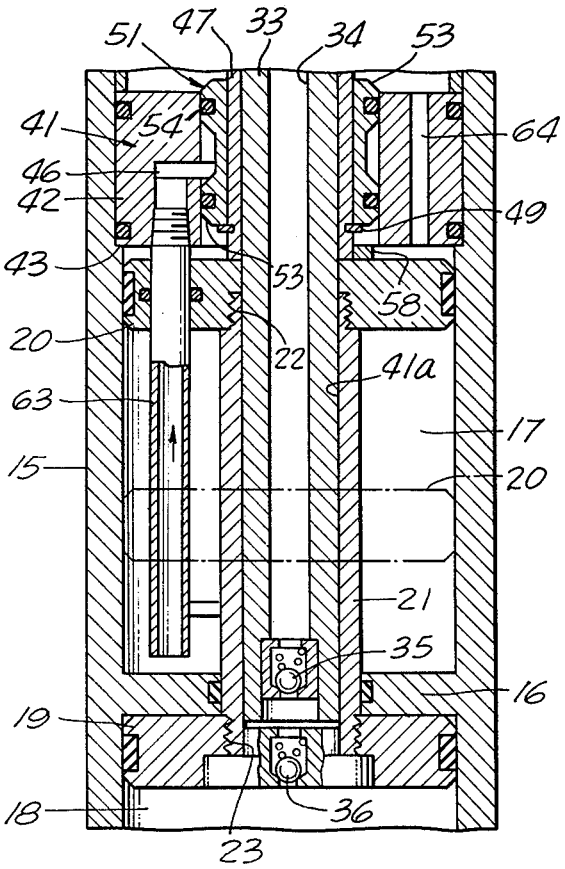
FIG. 3 is a sectional, elevational, partially fragmentary view taken along the line 3—3 of FIG. 2.

Incoming fluid from 13 passes through slot 44 and via the spool annular slot to exit through third slot 46 into a further standpipe 63 (FIG. 3) which adds pressurized working liquid under the piston 20 causes it to rise. On the piston assembly rising the second stage of compression is achieved. Also, during piston rise the working that was in the housing cavity above the pistons from the previous cycle is pumped out through opening 64 in the valve body 42, through slot 45 and exit opening 14 to sump.

Although in the foregoing description the working fluid has been specified as a liquid, the compressor apparatus will operate satisfactorily where the working fluid is either a gas or a liquid. In fact, no change in the described construction would be required at all to drive the compressor with a gas. It would be feasible to power the compressor by a liquid for a period, flush the liquid from the apparatus and then immediately use a gaseous working fluid. This is made possible primarily by the use of a sleeve-type valve 41 whereas it was typical practice in prior compressors to use poppet valves which would not permit the flexibility in choice of working fluid.

In the practice of the present invention, there is provided an improved compressor in which the means carrying the working fluid are in surrounding heat exchanging relation to the means carrying the fluid being compressed thereby reducing the extremes of operating temperature encountered in known prior structures where such means are relatively separated from a heat exchanging standpoint.

Also, it is important to note that the simplified generally cylindrical construction with inlet means for the fluid to be compressed located at one end and the compressed fluid outlet located at the opposite end, this compressor is readily amenable to advantageous in-line use. In avoiding the unusual geometry cast housings used in prior known construction, the weight has been reduced on the order of 10 to 1.

A still further advantage is that whereas in the past it has been accepted practice to use a relatively large diameter driving piston to achieve the required compressing force, the described compressor uses a pair of relatively small diameter pistons. In this way, it is now possible to reduce weight substantially and achieve a more simplified geometry.

I claim:

1. A fluid compressor driven by a pressurized working liquid, comprising:

walls defining an open-ended hollow housing containing a first end plate in a housing open end and including a check valve permitting fluid flow into the housing from an external source of supply and preventing flow out;

a second end plate received in the housing other open end enclosing the housing;

a partition separating the housing interior into first and second chambers, said partition including a centrally located opening;

first and second pistons located within the first and second chambers respectively and interconnected by a hollow rigid tube extending through the partition central opening, the ends of said tube being received in openings passing through the pistons;

a check valve in the second piston opening allowing fluid flow from the second chamber into the tube interconnecting the pistons and preventing fluid flow in the opposite direction;

hollow standpipe means having one end affixed in openings in the partition and slidingly extending through accommodating openings in the first piston;

a rodlike member having a bore therethrough with one end secured within an opening in the second end plate and the remainder of said member extending into the housing first chamber and within the tube interconnecting the pistons;

a check valve within the inner end of the rodlike member bore permitting fluid flow from through the said check valve into the member bore and preventing fluid flow in the opposite direction;

valving means selectively actuable to a first valving mode providing pressurized working liquid on one side of the pistons and communicating the other side of the first piston to a liquid sump, and to a second valving mode providing pressurized working liquid to the other side of the first piston and communicating the first side of both pistons to a sump, said valving means includes a body member with a working liquid inlet opening, a liquid outlet opening, a chamber intermediate to and in communication with the inlet and outlet openings, walls defining said intermediate chamber including a first slotted opening communicating with the inlet, a second slotted opening communicating with the outlet opening and a third slotted opening communicating with a further standpipe slidingly extending through the first piston and having an end communicating with the housing first chamber, and a spool selectively positionable to connect the first and third slotted openings together in the first valving mode and the second and third slotted openings in the second valving mode; and means responsive to piston location for selectively actuating the mode of said valving means.

2. A fluid compressor as in claim 1, in which the valving means includes spring means for resiliently assisting change of mode.

* * * * *